US010408536B2

(12) United States Patent
Shelat et al.

(10) Patent No.: US 10,408,536 B2
(45) Date of Patent: Sep. 10, 2019

(54) SYSTEM AND METHOD FOR RECOVERY OF NEON AND HELIUM FROM AN AIR SEPARATION UNIT

(71) Applicants: Maulik R. Shelat, Williamsville, NY (US); Hanfei Tuo, East Amherst, NY (US); Nick J. Degenstein, East Amherst, NY (US); James R. Dray, Buffalo, NY (US)

(72) Inventors: Maulik R. Shelat, Williamsville, NY (US); Hanfei Tuo, East Amherst, NY (US); Nick J. Degenstein, East Amherst, NY (US); James R. Dray, Buffalo, NY (US)

(73) Assignee: PRAXAIR TECHNOLOGY, INC., Danbury, CT (US)

( * ) Notice: Subject to any disclaimer, the term of this patent is extended or adjusted under 35 U.S.C. 154(b) by 136 days.

(21) Appl. No.: 15/695,320

(22) Filed: Sep. 5, 2017

(65) Prior Publication Data

US 2019/0072325 A1 Mar. 7, 2019

(51) Int. Cl.
*F25J 3/04* (2006.01)
*F25J 5/00* (2006.01)

(52) U.S. Cl.
CPC ..... *F25J 3/04642* (2013.01); *F25J 3/0406* (2013.01); *F25J 3/0409* (2013.01);
(Continued)

(58) Field of Classification Search
CPC .. F25J 2200/32; F25J 2215/30; F25J 2215/32; F25J 2250/02; F25J 2250/10;
(Continued)

(56) References Cited

U.S. PATENT DOCUMENTS 2,497,589 A 2/1950 Dennis
4,824,453 A 4/1989 Rottmann et al.
(Continued)

FOREIGN PATENT DOCUMENTS

CN 104990366 A 10/2015
EP 2 322 888 A1 5/2011
(Continued)

OTHER PUBLICATIONS

Helmut Springman; "Die Erzeugung von Schutzgasen"; Berichte Aus Technik and Wissenschaft, Lind AG. Wiesbaden, DE, vol. 39, Jan. 1, 1976, pp. 48-54, XP009028243.
(Continued)

*Primary Examiner* — Henry T Crenshaw
(74) *Attorney, Agent, or Firm* — Robert J. Hampsch

(57) ABSTRACT

A system and method for neon recovery in a double column or triple column air separation unit is provided. The neon recovery system comprises a non-condensable stripping column configured to produce a liquid nitrogen-rich liquid column bottoms and a non-condensable gas containing overhead and one or more condensing units arranged to produce a crude neon vapor stream that contains greater than about 50% mole fraction of neon with the overall neon recovery exceeding 95%. In addition, there is minimal liquid nitrogen consumption and since much of the liquid nitrogen is recycled back to the lower pressure column of the air separation unit, there is minimal impact on the recovery of other products from the air separation unit.

19 Claims, 8 Drawing Sheets

(52) U.S. Cl.
CPC ..... *F25J 3/0443* (2013.01); *F25J 3/04187* (2013.01); *F25J 3/04296* (2013.01); *F25J 3/04412* (2013.01); *F25J 3/04624* (2013.01); *F25J 3/04678* (2013.01); *F25J 3/04872* (2013.01); *F25J 5/005* (2013.01); *F25J 2200/32* (2013.01); *F25J 2215/30* (2013.01); *F25J 2215/32* (2013.01); *F25J 2250/02* (2013.01); *F25J 2250/10* (2013.01)

(58) Field of Classification Search
CPC ..... F25J 3/0406; F25J 3/0409; F25J 3/04187; F25J 3/04296; F25J 3/04412; F25J 3/0443; F25J 3/04624; F25J 3/04642; F25J 3/04678; F25J 3/04872; F25J 5/005
See application file for complete search history.

(56) References Cited

U.S. PATENT DOCUMENTS

| | | | | | |
|---|---|---|---|---|---|
| 4,854,954 | A * | 8/1989 | Erickson | F25J 3/0209 | 62/651 |
| 4,867,772 | A * | 9/1989 | Eyre | F25J 3/0426 | 62/656 |
| 5,100,446 | A | 3/1992 | Wisz | | |
| 5,106,398 | A * | 4/1992 | Dunn | F25J 3/04412 | 62/643 |
| 5,137,559 | A * | 8/1992 | Agrawal | F25J 3/04084 | 62/652 |
| 5,167,125 | A | 12/1992 | Agrawal | | |
| 5,230,217 | A * | 7/1993 | Agrawal | F25J 3/04303 | 62/654 |
| 5,289,688 | A * | 3/1994 | Agrawal | B01D 3/146 | 62/651 |
| 5,425,241 | A * | 6/1995 | Agrawal | F25J 3/04715 | 62/643 |
| 5,511,380 | A * | 4/1996 | Ha | F25J 3/04296 | 62/645 |
| 5,689,973 | A * | 11/1997 | Naumovitz | F25J 3/04048 | 62/652 |
| 5,836,174 | A * | 11/1998 | Billingham | B01D 3/141 | 62/643 |
| 5,899,093 | A * | 5/1999 | Ha | F25J 3/04254 | 62/627 |
| 7,299,656 | B2 | 11/2007 | Weber et al. | | |
| 2010/0221168 | A1 | 9/2010 | Bernstein | | |
| 2019/0003766 | A1 | 1/2019 | Howard | | |
| 2019/0072325 | A1 * | 3/2019 | Shelat | F25J 3/04872 | |

FOREIGN PATENT DOCUMENTS

| | | |
|---|---|---|
| JP | S62-41572 | 2/1987 |
| JP | S62 194179 A | 8/1987 |
| JP | H08 261645 | 10/1996 |
| SU | 585 728 A1 | 2/1981 |

OTHER PUBLICATIONS

V. P. Aleseev et al., "Neon-helium mixture enrichment—by neon-helium mixture throttling, and using mixture as coolant in last stage", WPI/Thomson, Vo. 1981, No. 26, Mar. 23, 1981, XP002589641 (Corresponding to SU 585 728 A1).

* cited by examiner

SYSTEM AND METHOD FOR RECOVERY OF NEON AND HELIUM FROM AN AIR SEPARATION UNIT

TECHNICAL FIELD

The present invention relates to a system and method for recovery of rare gases such as neon, helium, xenon, and krypton from an air separation plant, and more particularly, to an integrated recovery system and method for recovery of neon and other non-condensable gases that includes a non-condensable stripping column arranged in operative association with a condenser-reboiler and fully integrated within an air separation unit. The recovered crude neon vapor stream contains greater than about 50% mole fraction of neon with the overall neon recovery being greater than about 95%.

BACKGROUND

A cryogenic air separation unit (ASU) is typically designed, constructed and operated to meet the base-load product slate demands/requirements for one or more end-user customers and optionally the local or merchant liquid product market demands. Product slate requirements typically include a target volume of high pressure gaseous oxygen, as well as other primary co-products such as gaseous nitrogen, liquid oxygen, liquid nitrogen, and/or liquid argon. The air separation unit is typically designed and operated based, in part, on the selected design conditions, including the typical day ambient conditions as well as the available utility/power supply costs and conditions.

Although present in air in very small quantities, rare gases such as neon, xenon, krypton and helium are capable of being extracted from a cryogenic air separation unit by means of a rare gas recovery system that produces a crude stream containing the targeted rare gases. Because of the low concentration of the rare gases in air, the recovery of these rare gas co-products is typically not designed into product slate requirements of the air separation unit and therefore the rare gas recovery systems are often not fully integrated into the air separation unit.

For example, neon may be recovered during the cryogenic distillation of air by passing a neon-containing stream from a cryogenic air separation unit through a stand-alone neon purification train, which may include a non-condensable stripping column and a non-cryogenic pressure swing adsorption system to produce a crude neon product (See e.g. U.S. Pat. No. 5,100,446). The crude neon product is then passed to a neon refinery where the crude neon stream is processed by removing helium and hydrogen to produce a refined neon product. For example, the neon recovery system disclosed in U.S. Pat. No. 5,100,446 has only moderate neon recovery about 80% because the neon containing stream that feeds to downstream neon stripping column is from non-condensable vent stream from main condenser-reboiler.

Moreover, where the rare gas recovery systems are coupled or partially integrated into the air separation unit as shown in U.S. Pat. Nos. 5,167,125 and 7,299,656; the rare gas recovery systems often adversely impact the design and operation of the air separation unit with respect to the production of the other components of air because a relatively large flow of nitrogen from the air separation unit must be taken in order to produce a crude neon vapor stream. For example. the low pressure (i.e. about 20 psia) neon recovery system disclosed in U.S. Pat. No. 7,299,656 has a very low neon concentration in the crude neon vapor stream of only about 1300 ppm, and therefore the crude neon product taken out from air separation unit is as high as almost 4% of liquid nitrogen reflux that is fed to the lower pressure column. Such significant loss of liquid flow that would be otherwise used as liquid reflux in the lower pressure column adversely impacts the separation and recovery of other product slates. In addition, such low neon concentration (i.e. 1333 ppm) crude product will cause higher associated operation cost in terms of compression power and liquid nitrogen usage to produce the final refined neon product. See also United States Patent Application Publication NO. 2010/0221168 which discloses a neon recovery system. The concentration of neon in the crude neon vapor stream is also relatively low at about 5.8%, and the recovery system is only applicable to the air separation unit with dirty shelf liquid withdraw where the liquid reflux fed to the lower pressure column is taken from the intermediate location of the higher pressure column.

What is needed is a rare gas or non-condensable gas recovery system that can produce a crude neon vapor stream that contains greater than about 50% mole fraction of neon and demonstrate an overall neon recovery of greater than about 95% with minimal liquid nitrogen consumption and minimal impact on recovery of other product slates in the air separation unit.

SUMMARY OF THE INVENTION

The present invention may be characterized as a neon recovery system for a double column or triple column air separation unit comprising: (i) a non-condensable stripping column configured to receive a portion of a liquid nitrogen condensate stream from the main condenser-reboiler and a stream of nitrogen rich shelf vapor from the higher pressure column, the non-condensable stripping column configured to produce a liquid nitrogen column bottoms and a non-condensable gas containing overhead; and (ii) a two-stage reflux condenser-kettle boiler configured to receive the non-condensable gas containing overhead from the non-condensable stripping column, a first condensing medium, and a second condensing medium and configured to produce a condensate that is released into or directed to the non-condensable stripping column, a first stream formed from partial vaporization of the first condensing medium, a second stream formed from vaporization or partial vaporization of the second condensing medium, and a neon containing vent stream that contains greater than about 50% mole fraction of crude neon vapor. All or a portion of the liquid nitrogen column bottoms is subcooled to produce a subcooled liquid nitrogen stream and the second condensing medium is a portion of the subcooled liquid nitrogen stream.

The present invention may also be characterized as a method for recovery of neon from a double column or triple column air separation unit comprising the steps of: (a) directing a stream of liquid nitrogen from the main condenser-reboiler and a stream of nitrogen rich shelf vapor from the higher pressure column of the air separation unit to a non-condensable stripping column configured to produce liquid nitrogen column bottoms and a non-condensable containing overhead; (b) subcooling all or a portion of the liquid nitrogen column bottoms to produce a subcooled liquid nitrogen stream; and (c) condensing nitrogen from the non-condensable gas containing overhead against a first condensing medium and a portion of the subcooled liquid nitrogen stream in a two-stage reflux condenser-kettle boiler while vaporizing or partially vaporizing the first condensing medium and the second condensing medium to produce a condensate, a first stream formed from the partial vaporization of the first condensing medium, a second stream formed from the vaporization or partial vaporization of the second condensing medium, and a neon containing vent stream that contains greater than about 50% mole fraction of crude neon vapor. In addition, the neon containing vent stream further contains greater than about 10% mole fraction of helium.

In the embodiments that utilize the two stage reflux condenser-boiler arrangements, one of the refrigeration sources (i.e. first condensing medium) for the two stage reflux condenser-boiler may be a kettle stream from the heat exchanger system of the air separation unit or a kettle stream from the argon condenser of the air separation unit. Likewise, the boil-off stream from the partial vaporization of the first condensing medium may be directed to the lower pressure column or the argon condenser of the air separation unit.

The present invention may be further characterized as a neon recovery system for a double column air separation unit comprising: (i) a non-condensable stripping column configured to receive a portion of a liquid nitrogen condensate stream from the main condenser-reboiler and a stream of nitrogen rich shelf vapor from the higher pressure column of the air separation unit, the non-condensable stripping column is further configured to produce a liquid nitrogen column bottoms and a non-condensable gas containing overhead; (ii) a stripping column condenser configured to receive the non-condensable gas containing overhead from the non-condensable stripping column, and a first condensing medium, the stripping column condenser is further configured to produce a condensate that is released into or directed to the non-condensable stripping column, a first stream formed from the vaporization or partial vaporization of the first condensing medium and a non-condensable containing vent stream; and (iii) a reflux condenser configured to receive the non-condensable gas containing vent stream from the stripping column condenser and a second condensing medium, the reflux condenser further configured to produce a condensate that is directed to the non-condensable stripping column, a second stream formed from the vaporization or partial vaporization of the second condensing medium, and a neon containing vent stream that contains greater than about 50% mole fraction of crude neon vapor, wherein all or a portion of the liquid nitrogen column bottoms is subcooled to produce a subcooled liquid nitrogen stream and the second condensing medium is a portion of the subcooled liquid nitrogen stream.

Lastly, the present invention may be still further characterized as a method for recovery of neon from a double column air separation unit comprising the steps of: (a) directing a stream of liquid nitrogen from the main condenser-reboiler and a stream of nitrogen-rich shelf vapor from the higher pressure column of the double column air separation unit to a non-condensable stripping column that is configured to produce liquid nitrogen column bottoms and non-condensable containing overhead; (b) subcooling all or a portion of the liquid nitrogen column bottoms to produce a subcooled liquid nitrogen stream; (c) condensing nitrogen from the non-condensable gas containing overhead against a first condensing medium to produce a condensate and a neon containing vent stream while vaporizing the first condensing medium to produce a first stream formed from the vaporization of the first condensing medium; (d) directing the neon containing vent stream to a reflux condenser; and (e) further condensing nitrogen from the neon containing vent stream against a portion of the subcooled liquid nitrogen stream to produce a nitrogen condensate and a crude neon vapor stream that contains greater than about 50% mole fraction of neon while vaporizing or partially vaporizing the portion of the subcooled liquid nitrogen stream to produce a second stream formed from the vaporization or partial vaporization of the portion of the subcooled liquid nitrogen stream.

In the embodiments that utilize stripping column condensers, the stripping column condenser may be a reflux condenser integrated into the non-condensable stripping column that utilizes nitrogen as the refrigeration source (i.e. first condensing medium). In such embodiments, the first condensing medium may comprise a portion of the liquid nitrogen column bottoms while the boil-off stream from the reflux condenser may be recycled to the non-condensable stripping column via a nitrogen cold compressor.

Alternatively, where a source of liquid oxygen is used as the refrigeration source (i.e. first condensing medium), the condenser may be a thermosyphon type condenser or a once-through condenser. In such embodiments, the first condensing medium may be a stream of liquid oxygen from the lower pressure column of the air separation unit while the boil-off stream from the reflux condenser may be directed back to the lower pressure column of the air separation unit.

In some or all of the embodiments of the present invention, the subcooled liquid nitrogen reflux stream may be subcooled via indirect heat exchange with a nitrogen column overhead of the lower pressure column of the air separation unit. In addition to directing a portion of the subcooled liquid nitrogen reflux stream to the reflux condenser or neon upgrader, other portions of the subcooled liquid nitrogen reflux stream may be directed to the lower pressure column as a reflux stream and/or taken as a liquid nitrogen product stream.

BRIEF DESCRIPTION OF THE DRAWINGS

While the present invention concludes with claims distinctly pointing out the subject matter that Applicants regard as their invention, it is believed that the invention will be better understood when taken in connection with the accompanying drawings in which:

DETAILED DESCRIPTION

Figure 1:
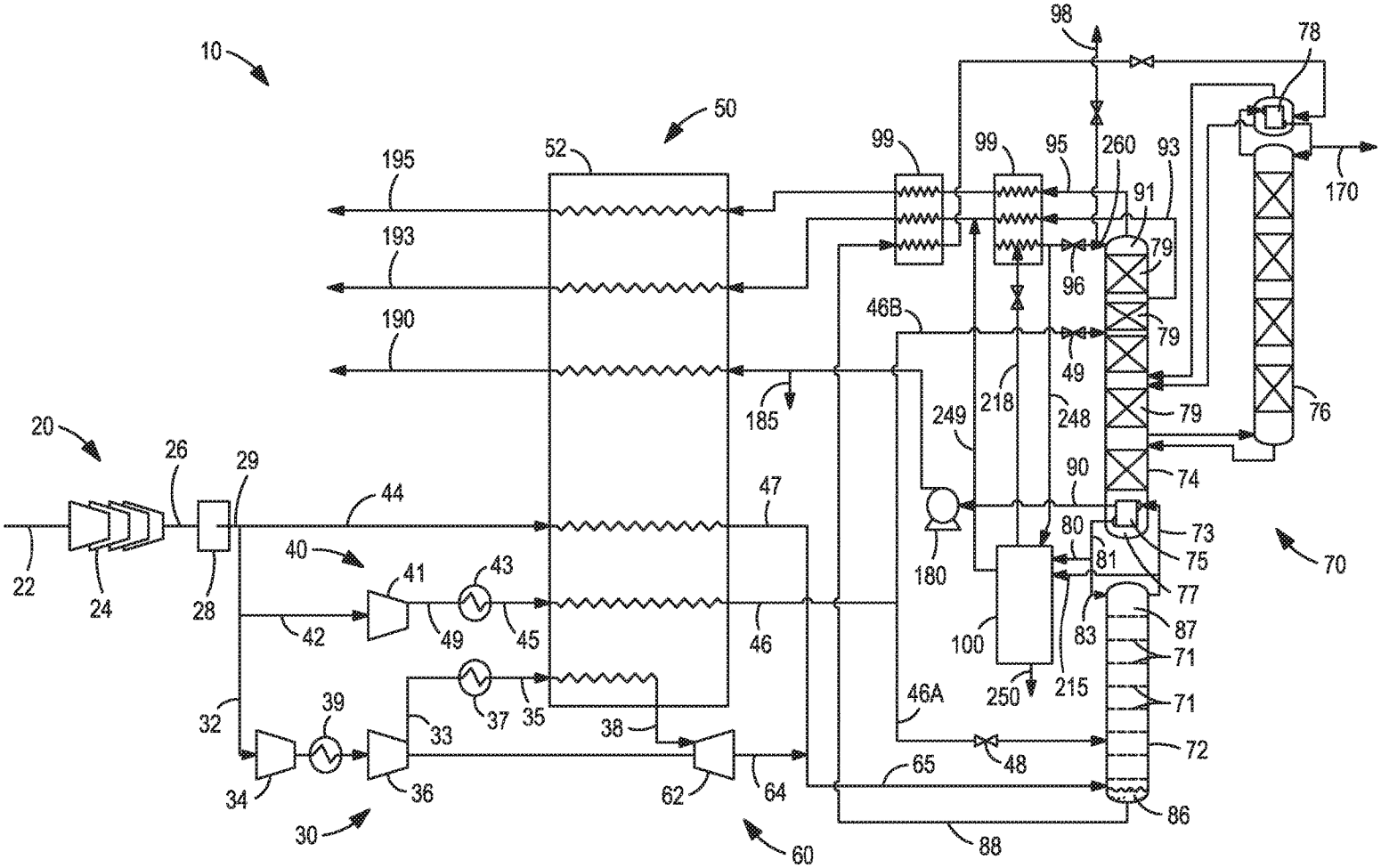
FIG. 1 is a partial schematic representation of a cryogenic air separation unit with an embodiment of the present non-condensable gas recovery system.
Figure 3:
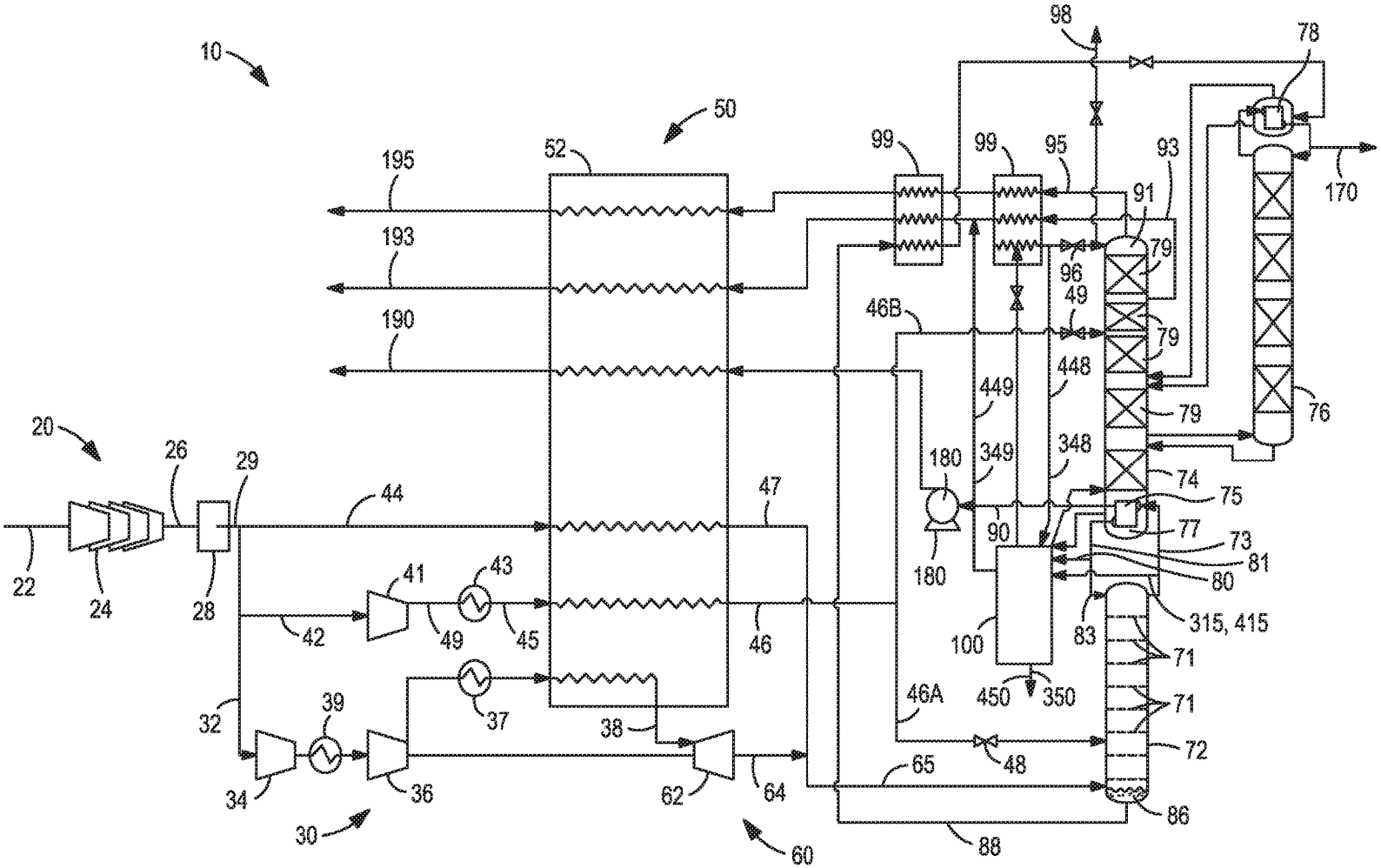
FIG. 3 is a partial schematic representation of a cryogenic air separation unit with alternate embodiments of the non-condensable gas recovery system.
Figure 6:
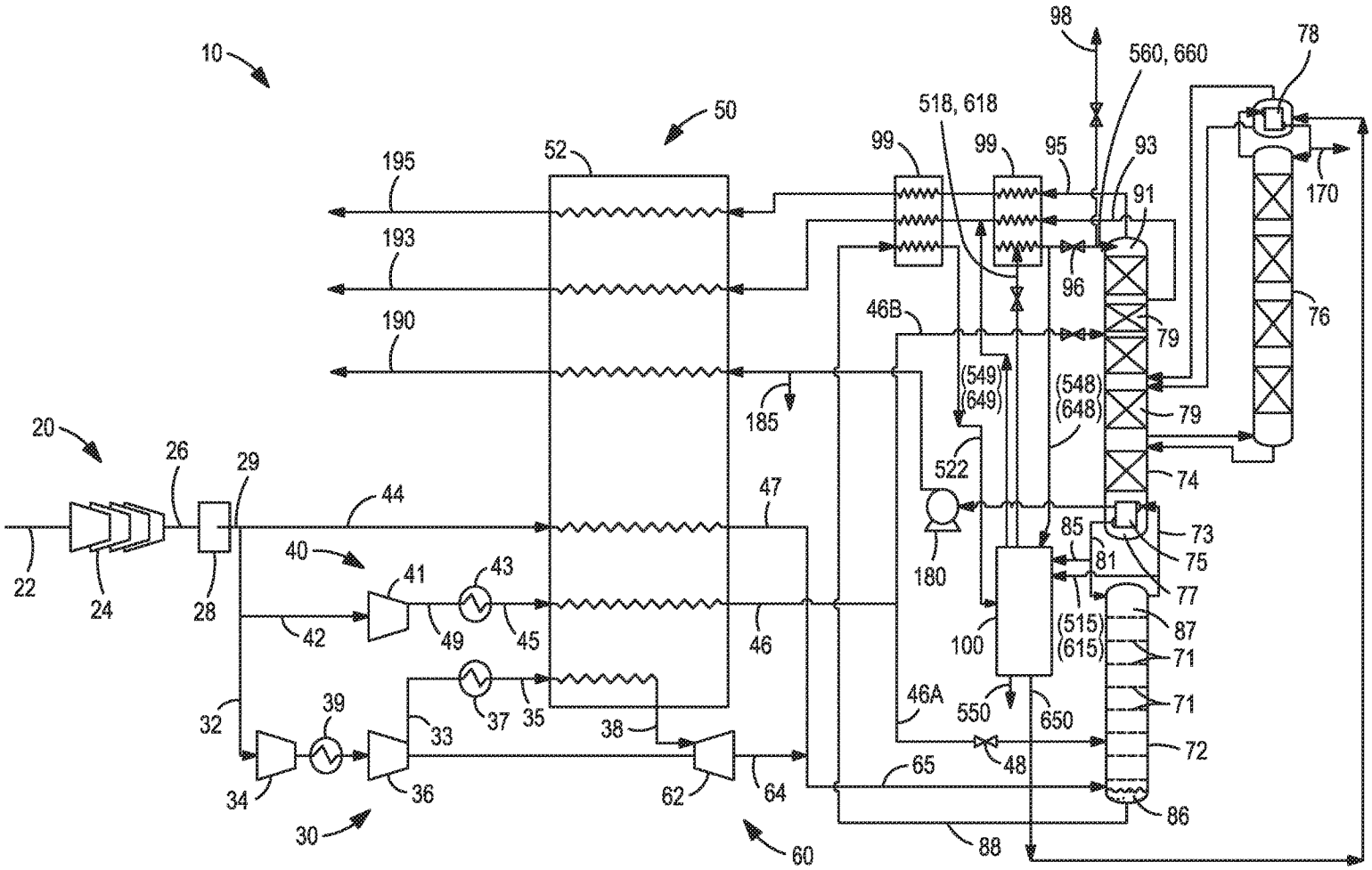
FIG. 6 is a partial schematic representation of a cryogenic air separation unit with yet further embodiments of the present non-condensable gas recovery system.

Turning now to FIGS. 1, 3, and 6, there is shown simplified illustrations of a cryogenic air separation plant also commonly referred to as an air separation unit 10. In a broad sense, the depicted air separation units include a main feed air compression train 20, a turbine air circuit 30, a booster air circuit 40, a main or primary heat exchanger system 50, a turbine based refrigeration circuit 60 and a distillation column system 70. As used herein, the main feed air compression train, the optional turbine air circuit, and the booster air circuit, collectively comprise the 'warm-end' air compression circuit. Similarly, the main or primary heat exchanger, portions of the turbine based refrigeration circuit and portions of the distillation column system are referred to as the 'cold-end' systems/equipment that are typically housed in one or more insulated cold boxes.

Warm End Air Compression Circuit

In the main feed compression train shown in FIGS. 1, 3, and 6, the incoming feed air 22 is typically drawn through an air suction filter house (ASFH) and is compressed in a multi-stage, intercooled main air compressor arrangement 24 to a pressure that can be between about 5 bar(a) and about 15 bar(a). This main air compressor arrangement 24 may include integrally geared compressor stages or a direct drive compressor stages, arranged in series or in parallel. The compressed air 26 exiting the main air compressor arrangement 24 is fed to an aftercooler or (not shown) with integral demister to remove the free moisture in the incoming feed air stream. The heat of compression from the final stages of compression for the main air compressor arrangement 24 is removed in aftercoolers by cooling the compressed feed air with cooling tower water. The condensate from this aftercooler as well as some of the intercoolers in the main air compression arrangement 24 is preferably piped to a condensate tank and used to supply water to other portions of the air separation plant.

The cool, dry compressed air feed 26 is then purified in a pre-purification unit 28 to remove high boiling contaminants from the cool, dry compressed air feed. A pre-purification unit 28, as is well known in the art, typically contains two beds of alumina and/or molecular sieve operating in accordance with a temperature and/or pressure swing adsorption cycle in which moisture and other impurities, such as carbon dioxide, water vapor and hydrocarbons, are adsorbed. While one of the beds is used for pre-purification of the cool, dry compressed air feed while the other bed is regenerated, preferably with a portion of the waste nitrogen from the air separation unit. The two beds switch service periodically. Particulates are removed from the compressed, pre-purified feed air in a dust filter disposed downstream of the pre-purification unit 28 to produce the compressed, purified feed air stream 29.

The compressed, purified feed air stream 29 is separated into oxygen-rich, nitrogen-rich, and argon-rich fractions (or argon product streams 170) in a plurality of distillation columns including a higher pressure column 72, a lower pressure column 74, and optionally, an argon column 76. Prior to such distillation however, the compressed, pre-purified feed air stream 29 is typically split into a plurality of feed air streams 42, 44, and 32, which may include a boiler air stream 42 and a turbine air stream 32. The boiler air stream 42 and turbine air stream 32 may be further compressed in compressors 41, 34, and 36 and subsequently cooled in aftercoolers 43, 39 and 37 to form compressed streams 49 and 33 which are then further cooled to temperatures required for rectification in the main heat exchanger 52. Cooling of the air streams 44, 45, and 35 in the main heat exchanger 52 is preferably accomplished by way of indirect heat exchange with the warming streams which include the oxygen streams 190, and nitrogen streams 193, 195 from the distillation column system 70 to produce cooled feed air streams 47, 46, and 38.

As explained in more detail below, cooled feed air stream 38 is expanded in the turbine based refrigeration circuit 60 to produce feed air stream 64 that is directed to the higher pressure column 72. Liquid air stream 46 is subsequently divided into liquid air streams 46A, 46B which are then partially expanded in expansion valve(s) 48, 49 for introduction into the higher pressure column 72 and the lower pressure column 74 while cooled feed air stream 47 is directed to the higher pressure column 72. Refrigeration for the air separation unit 10 is also typically generated by the turbine air stream circuit 30 and other associated cold and/or warm turbine arrangements, such as turbine 62 disposed within the turbine based refrigeration circuit 60 or any optional closed loop warm refrigeration circuits, as generally known in the art.

Cold End Systems/Equipment

The main or primary heat exchanger 52 is preferably a brazed aluminum plate-fin type heat exchanger. Such heat exchangers are advantageous due to their compact design, high heat transfer rates and their ability to process multiple streams. They are manufactured as fully brazed and welded pressure vessels. For small air separation unit units, a heat exchanger comprising a single core may be sufficient. For larger air separation unit units handling higher flows, the heat exchanger may be constructed from several cores which must be connected in parallel or series.

Turbine based refrigeration circuits are often referred to as either a lower column turbine (LCT) arrangement or an upper column turbine (UCT) arrangement which are used to provide refrigeration to a two-column or three column cryogenic air distillation column systems. In the LCT arrangement shown in FIG. 1, the compressed, cooled turbine air stream 35 is preferably at a pressure in the range from between about 20 bar(a) to about 60 bar(a). The compressed, cooled turbine air stream 35 is directed or introduced into main or primary heat exchanger 52 in which it is partially cooled to a temperature in a range of between about 160 and about 220 Kelvin to form a partially cooled, compressed turbine air stream 38 that is subsequently introduced into a turbo-expander 62 to produce a cold exhaust stream 64 that is introduced into the higher pressure column 72 of distillation column system 70. The supplemental refrigeration created by the expansion of the stream is thus imparted directly to the higher pressure column 72 thereby alleviating some of the cooling duty of the main heat exchanger 52. In some embodiments, turbo-expander 62 may be coupled with booster compressor 36 used to further compress the turbine air stream 32, either directly or by appropriate gearing.

While the turbine based refrigeration circuit illustrated in FIG. 1 is shown as a lower column turbine (LCT) circuit where the expanded exhaust stream is fed to the higher pressure column 72 of the distillation column system 70, it is contemplated that the turbine based refrigeration circuit alternatively may be an upper column turbine (UCT) circuit where the turbine exhaust stream is directed to the lower pressure column. Still further, the turbine based refrigeration circuit may be a combination of an LCT circuit and UCT circuit.

Similarly, in an alternate embodiment that employs a UCT arrangement (not shown), a portion of the purified and compressed feed air may be partially cooled in the primary heat exchanger, and then all or a portion of this partially cooled stream is diverted to a warm turbo-expander. The expanded gas stream or exhaust stream from the warm turbo-expander is then directed to the lower pressure column in the two-column or multi-column cryogenic air distillation column system. The cooling or supplemental refrigeration created by the expansion of the exhaust stream is thus imparted directly to the lower pressure column thereby alleviating some of the cooling duty of the main heat exchanger.

The aforementioned components of the feed air streams, namely oxygen, nitrogen, and argon are separated within the distillation column system 70 that includes a higher pressure column 72 and a lower pressure column 74. It is understood that if argon were a necessary product from the air separation unit 10, an argon column 76 and argon condenser 78 could be incorporated into the distillation column system 70. The higher pressure column 72 typically operates in the range from between about 20 bar(a) to about 60 bar(a) whereas the lower pressure column 74 operates at pressures between about 1.1 bar(a) to about 1.5 bar(a). The higher pressure column 72 and the lower pressure column 74 are preferably inked in a heat transfer relationship such that a nitrogen-rich vapor column overhead, extracted from proximate the top of higher pressure column as a stream 73, is condensed within a condenser-reboiler 75 located in the base of lower pressure column 74 against boiling an oxygen-rich liquid column bottoms 77. The boiling of oxygen-rich liquid column bottoms 77 initiates the formation of an ascending vapor phase within lower pressure column. The condensation produces a liquid nitrogen containing stream 81 that is divided into a reflux stream 83 that refluxes the lower pressure column to initiate the formation of descending liquid phase in such lower pressure column and a liquid nitrogen source stream 80 that is fed to the neon recovery system 100.

Exhaust stream 64 from the turbine air refrigeration circuit 60 is introduced into the higher pressure column 72 along with the streams 46 and 47 for rectification by contacting an ascending vapor phase of such mixture within a plurality of mass transfer contacting elements, illustrated as trays 71, with a descending liquid phase that is initiated by reflux stream 83. This produces crude liquid oxygen column bottoms 86, also known as kettle liquid, and the nitrogen-rich column overhead 87.

Lower pressure column 74 is also provided with a plurality of mass transfer contacting elements, that can be trays or structured packing or random packing or other known elements in the art of cryogenic air separation. The contacting elements in the lower pressure column 74 are illustrated as structured packing 79. As stated previously, the separation occurring within lower pressure column 74 produces an oxygen-rich liquid column bottoms 77 extracted as an oxygen-rich liquid stream 90 and a nitrogen-rich vapor column overhead 91 that is extracted as a nitrogen product stream 95. As shown in the drawings, the oxygen-rich liquid stream 90 may be pumped via pump 180 and taken as a pumped liquid oxygen product 185 or directed to the main heat exchanger 52 where it is warmed to produce a gaseous oxygen product stream 190. Additionally, a waste stream 93 is also extracted from the lower pressure column 74 to control the purity of nitrogen product stream 95. Both nitrogen product stream 95 and waste stream 93 are passed through one or more subcooling units 99 designed to subcool the kettle stream 88 and/or the reflux stream. A portion of the cooled reflux stream 260 may optionally be taken as a liquid product stream 98 and the remaining portion may be introduced into lower pressure column 74 after passing through expansion valve 96. After passage through subcooling units 99, nitrogen product stream 95 and waste stream 93 are fully warmed within main or primary heat exchanger 52 to produce a warmed nitrogen product stream 195 and a warmed waste stream 193. Although not shown, the warmed waste stream 193 may be used to regenerate the adsorbents within the pre-purification unit 28.

Systems/Equipment for Recovery of Neon and Helium

FIGS. 2, 4, 5, 7, and 8 schematically depict the non-condensable gas recovery system configured for the enhanced recovery of a crude non-condensable gas stream, such as a crude neon containing vapor stream.

Figure 2:
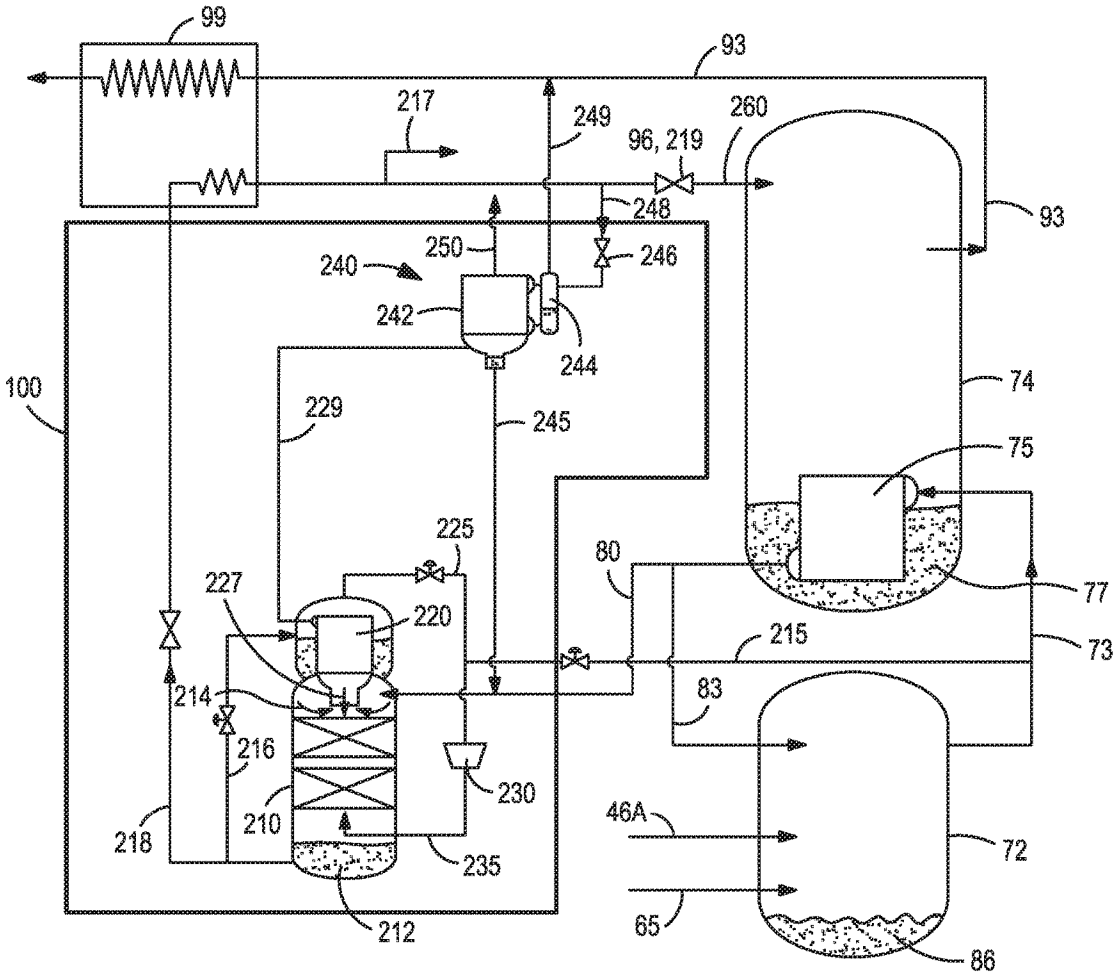
FIG. 2 is a more detailed schematic representation of the non-condensable gas recovery system of FIG. 1.

As seen in FIG. 2, an embodiment of the non-condensable gas recovery system 100 comprises a non-condensable stripping column (NSC) 210; a stripping column condenser 220, a cold compressor 230, and a neon upgrader 240. The non-condensable stripping column 210 is configured to receive a portion of nitrogen shelf vapor 215 from the higher pressure column 72 and a recycled portion of the boil-off nitrogen vapor 225 from the stripping column condenser 220. These two streams 215, 225 are combined and then further compressed in the nitrogen cold compressor 230. The further compressed nitrogen stream 235 is introduced proximate the bottom of the non-condensable stripping column 210 as an ascending vapor stream while the descending liquid reflux for the non-condensable stripping column 210 includes: (i) a stream of liquid nitrogen exiting the main condenser-reboiler 80; (ii) a stream of liquid nitrogen condensate exiting the stripping column condenser 227; and (iii) a stream of liquid nitrogen condensate 245 exiting the neon upgrader 240 (i.e. reflux condenser 242). The non-condensable stripping column 210 produces liquid nitrogen bottoms 212 and an overhead gas 214 containing higher concentrations of neon that is fed into stripping column condenser 220.

In the illustrated embodiment, the non-condensable stripping column 210 operates at a higher pressure than that of the higher pressure column 72 of the air separation unit 10 in order to provide the heat transfer temperature difference for the stripping column condenser 220. Because the non-condensable stripping column 210 is operated at a higher pressure than the high pressure column 72, the non-condensable stripping column 210 is preferably positioned at lower elevation than the stream of liquid nitrogen exiting the main condenser-reboiler 80 (i.e. shelf liquid take-off from high pressure column) such that descending liquid reflux would be fed to the non-condensable stripping column 210 by gaining gravity head. As the ascending vapor (i.e. stripping vapor) rises along the non-condensable stripping column 210, the mass transfer occurring in the non-condensable stripping column 210 will concentrate the heavier components like oxygen, argon, nitrogen in the descending liquid phase, while the ascending vapor phase is enriched in light components like neon, hydrogen, and helium. As indicated above, the ascending vapor is introduced or fed to stripping column condenser 220.

The stripping column condenser 220 is preferably a reflux type or non-reflux type brazed aluminum heat exchanger preferably integrated with the non-condensable stripping column 210. A small stream or portion of the nitrogen rich liquid column bottoms 212 from the non-condensable stripping column 210 provides the first condensing medium 216 for the stripping column condenser 220 while the remaining portion of the nitrogen rich liquid column bottoms 212 is the liquid nitrogen reflux stream 218 that is subcooled in a subcooler unit 99 against a stream of waste nitrogen 93 from the air separation unit 10. Portions of the subcooled liquid nitrogen reflux stream 218 may optionally be taken as liquid nitrogen product 217, diverted to the neon upgrader 240 or expanded in valve 219 and returned as a reflux stream 260 to the lower pressure column 74 of the air separation unit 10. The illustrated subcooler unit 99 may be an existing subcooler in the air separation unit 10 or may be a standalone subcooler unit that forms part of the non-condensable gas recovery system 100.

The boil-off nitrogen vapor 225 from the stripping column condenser 220 is recycled back to the non-condensable stripping column 210 via the nitrogen cold compressor 230. On the condensing side of the stripping column condenser 220, non-condensables such as hydrogen, helium, neon are withdrawn from the non-condensable vent port as a non-condensable containing vent stream 229 which is directed or fed to the neon upgrader 240. The neon upgrader 240 preferably comprises a liquid nitrogen reflux condenser 242, a phase separator 244, and a nitrogen flow control valve 246. The liquid nitrogen reflux condenser 242 is preferably a reflux type brazed aluminum heat exchanger that condenses the non-condensable containing vent stream 229 against a second condensing medium 248, preferably a portion of the subcooled liquid nitrogen reflux stream. The boil-off stream 249 is removed from the neon recovery system 100 and fed into the waste stream 93. The residual vapor that does not condense within the liquid nitrogen reflux condenser 242 is withdrawn from the top of the liquid nitrogen reflux condenser 242 as a crude neon vapor stream 250 that contains greater than about 50% mole fraction of neon. The crude neon vapor stream preferably further contains greater than about 10% mole fraction of helium.

The overall neon recovery for the illustrated non-condensable gas recovery system 100 is above 95%. An additional benefit of the depicted non-condensable gas recovery system 100 is that there is minimal liquid nitrogen consumption and since much of the liquid nitrogen is fed to the lower pressure column 74 of the air separation unit 10, there is minimal impact on the separation and recovery of other product slates for the air separation unit 10. This is because using an efficient cold compression system to recycle the boil-off nitrogen to the non-condensable stripping column and use of the nitrogen-rich column bottoms to provide refrigeration duty for the stripping column condenser 220.

Figure 4:
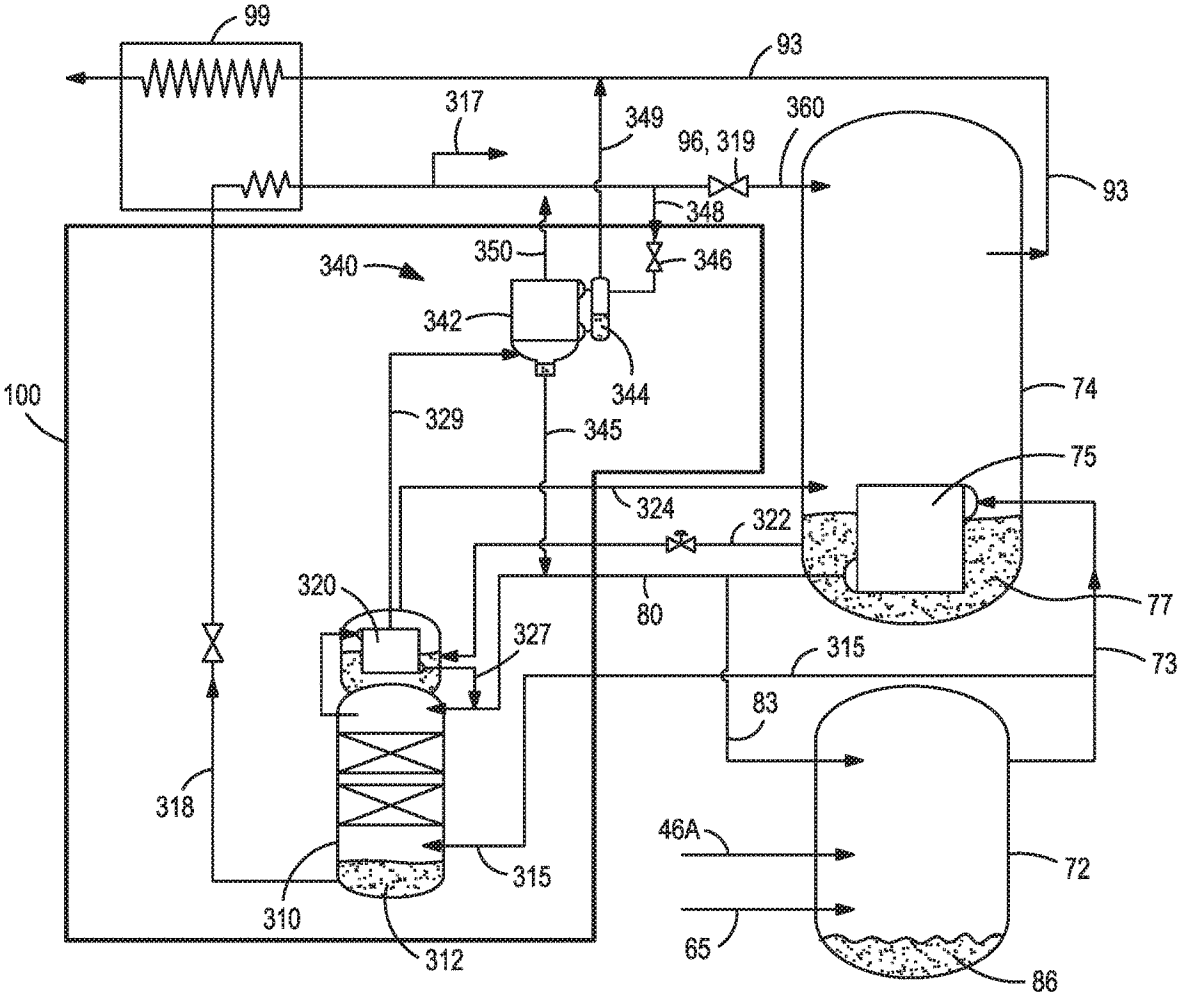
FIG. 4 is a more detailed schematic representation of an embodiment of the non-condensable gas recovery system of FIG. 3.
Figure 5:
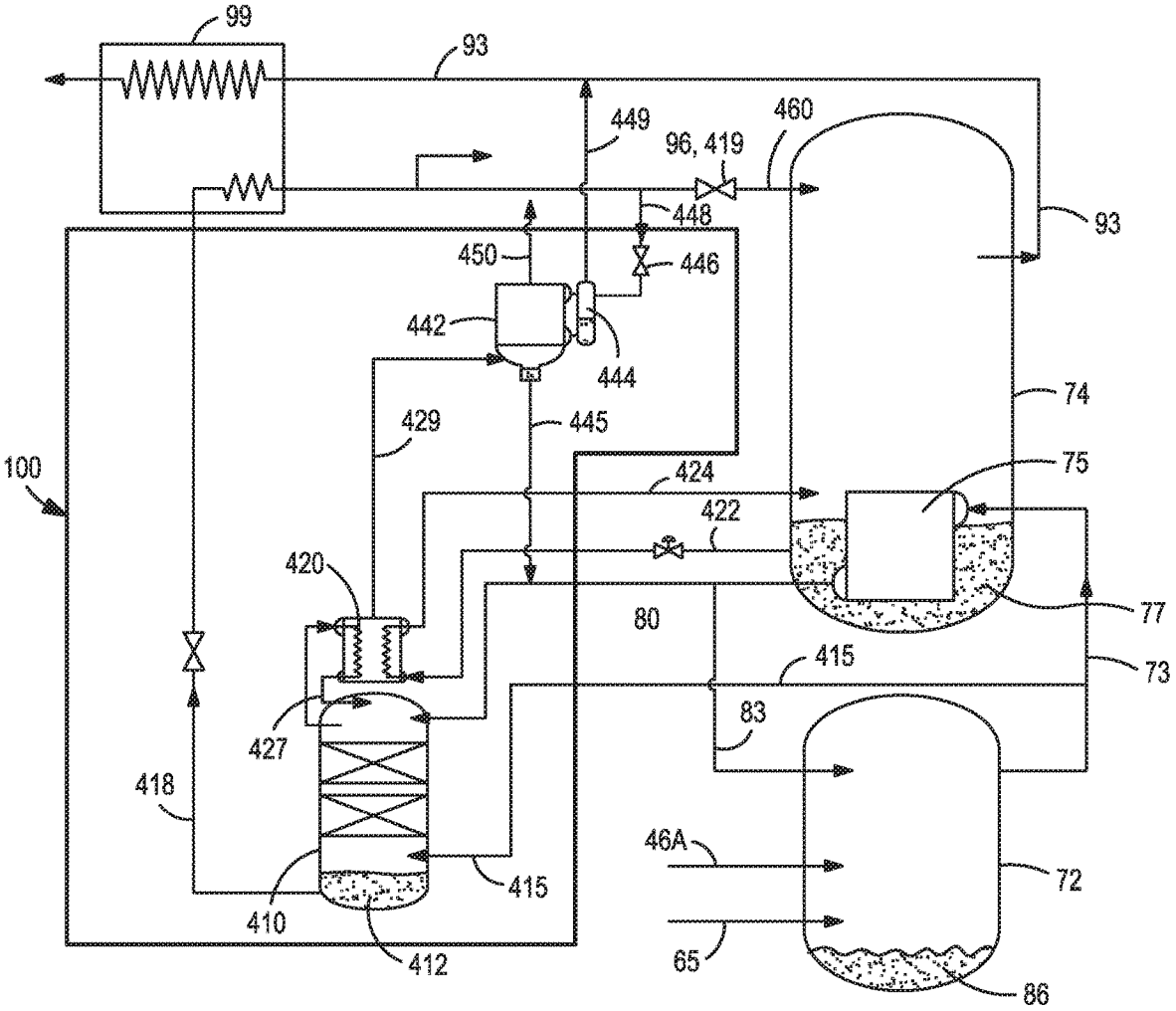
FIG. 5 is a more detailed schematic representation of another embodiment of the non-condensable gas recovery system of FIG. 3.

In many regards, the embodiments of FIG. 4 and FIG. 5 are quite similar to that shown in FIG. 2 with corresponding elements and streams having corresponding reference numerals but numbered in the 300 series in FIG. 4 and in the 400 series in FIG. 5. The primary differences between FIG. 2 and the embodiments of FIGS. 4 and 5 being: the arrangement of the stripping column condenser 320, 420 and condensing mediums 322, 422; the elimination of nitrogen cold compressor 230; and the integration of the stripping column condenser 320, 420 with the distillation column system 70 of the air separation unit 10.

In the embodiment shown in FIG. 4, the stripping column condenser 320 is a thermosyphon type condenser that may be a shell and tube condenser or a brazed aluminum heat exchanger that releases the non-condensable containing vent stream 329 into the reflux condenser 342 of the neon upgrader 340. In the embodiment shown in FIG. 5, the stripping column condenser 420 is a once-through boiling type condenser that may be a reflux type or non-reflux type condensing brazed aluminum heat exchanger that releases the non-condensable containing vent stream 429 into the reflux condenser 442 of the neon upgrader 440.

In both embodiments, the condensing medium for the stripping column condenser 320, 420 is a stream of liquid oxygen 322, 422 taken from the lower pressure column 72 of the air separation unit 10 and the boiled oxygen 324, 424 is returned to the lower pressure column 72 of the air separation unit 10. More specifically, liquid oxygen is preferably withdrawn from the sump of the lower pressure column 74 of the air separation unit 10 and fed by gravity to the boiling side of the stripper column condenser 320, 420. The liquid oxygen boils in the stripper column condenser 320, 420 to provide the refrigeration for vapor partial condensation. Because the stripper column condenser 320, 420 operates at higher pressure than lower pressure column 74 of the air separation unit 10, the boil-off oxygen vapor 324, 424 is returned back to a location proximate the bottom of lower pressure column 74. Preferably, the stripping column condenser 320, 420 is positioned below the lower pressure column sump to allow the oxygen flow to be driven by gravity in the embodiments shown in FIG. 4 and FIG. 5. Advantageously, it is the use of liquid oxygen to provide the refrigeration duty for stripping column condenser 320, 420 that eliminates the use of nitrogen cold compressor compared to the embodiment shown in FIG. 2.

As with the embodiment of FIG. 2, shelf vapor 315, 415 from the top of the high pressure column 72 is fed to the bottom of the non-condensable stripping column 320 as the ascending vapor while the descending liquid reflux for the non-condensable stripping column includes: (i) a stream of liquid nitrogen exiting the main condenser-reboiler 80; (ii) a stream of liquid nitrogen condensate exiting the stripping column condenser 327, 427; and (iii) a stream of liquid nitrogen condensate 345, 445 exiting the neon upgrader 340, 440 (i.e. reflux condenser 342, 442). Within the non-condensable stripping column 320, 420, the heavier components like oxygen, argon, nitrogen are concentrated in the descending liquid phase, while the ascending vapor phase is enriched in light components like neon, hydrogen, and helium.

In the embodiments of FIG. 4 and FIG. 5, all of the liquid nitrogen bottoms 312, 412 from the non-condensable stripping column 310, 410 provide the liquid nitrogen reflux stream 318, 418 that is subcooled in a subcooler unit 99 against a stream of waste nitrogen 93 from the air separation unit 10. As described above, portions of the subcooled liquid nitrogen reflux stream may optionally be taken as liquid nitrogen product 317, 417, diverted as stream 348, 448 to the liquid nitrogen reflux condenser 342, 442 or expanded in valve 319, 419 and returned as a reflux stream 360, 460 to the lower pressure column 74 of air separation unit 10.

Similar to the neon upgrader of FIG. 2, the neon upgrader 340, 440 of FIGS. 4 and 5 preferably comprises a liquid nitrogen reflux condenser 342, 442; a phase separator 344, 444; and a nitrogen flow control valve 346, 446. The liquid nitrogen reflux condenser 342, 442 condenses the non-condensable containing vent stream 329, 429 against a second condensing medium 348, 448 preferably a portion of the subcooled liquid nitrogen reflux stream. The boil-off stream 349, 449 is removed from the neon recovery system 100 and fed into the waste stream 93. The residual vapor that does not condense within the liquid nitrogen reflux condenser 342, 442 is withdrawn from the top of the liquid nitrogen reflux condenser 342, 442 as a crude neon vapor stream 350, 450.

Figure 7:
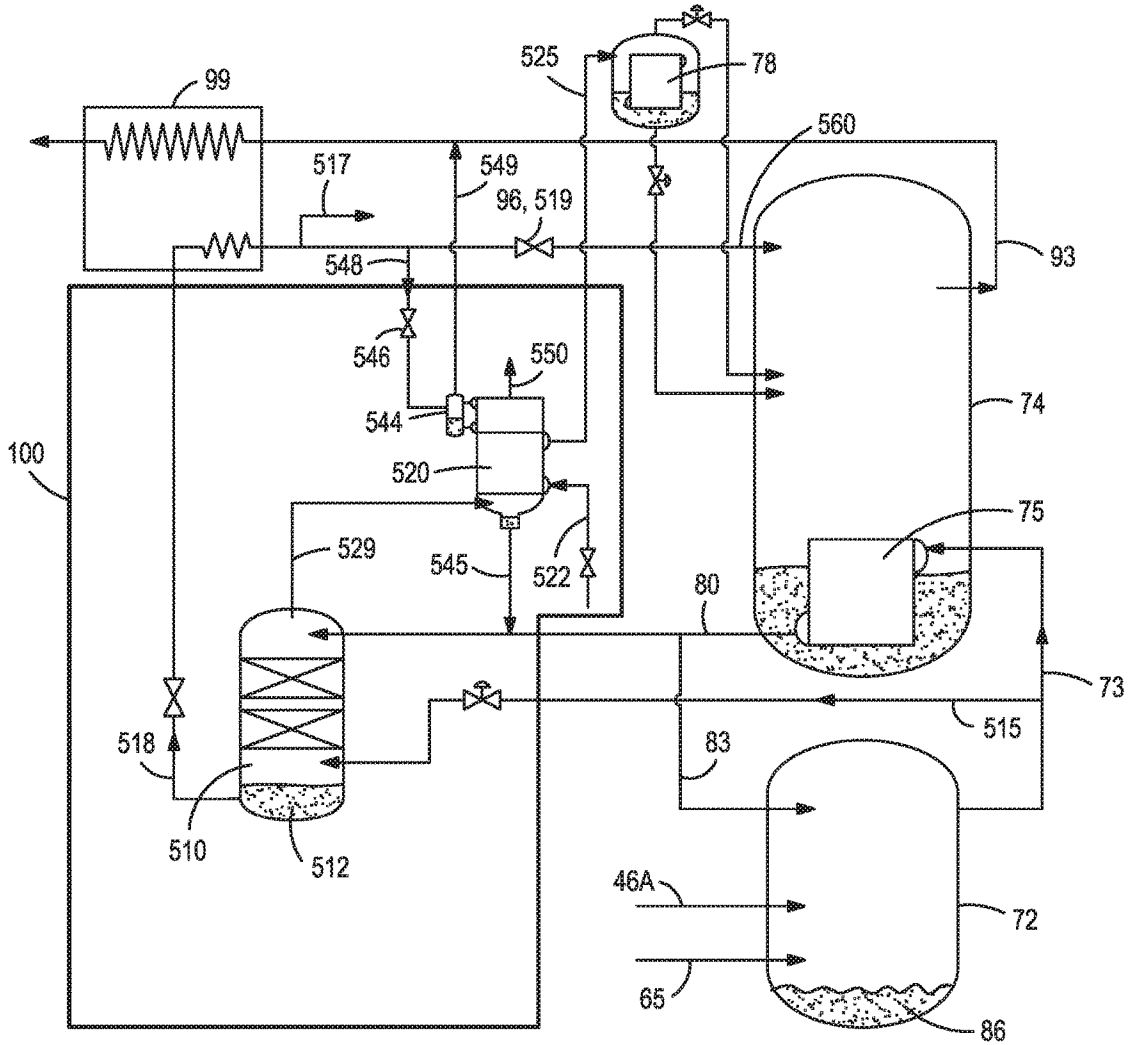
FIG. 7 is a more detailed schematic representation of the non-condensable gas recovery system of FIG. 6.
Figure 8:
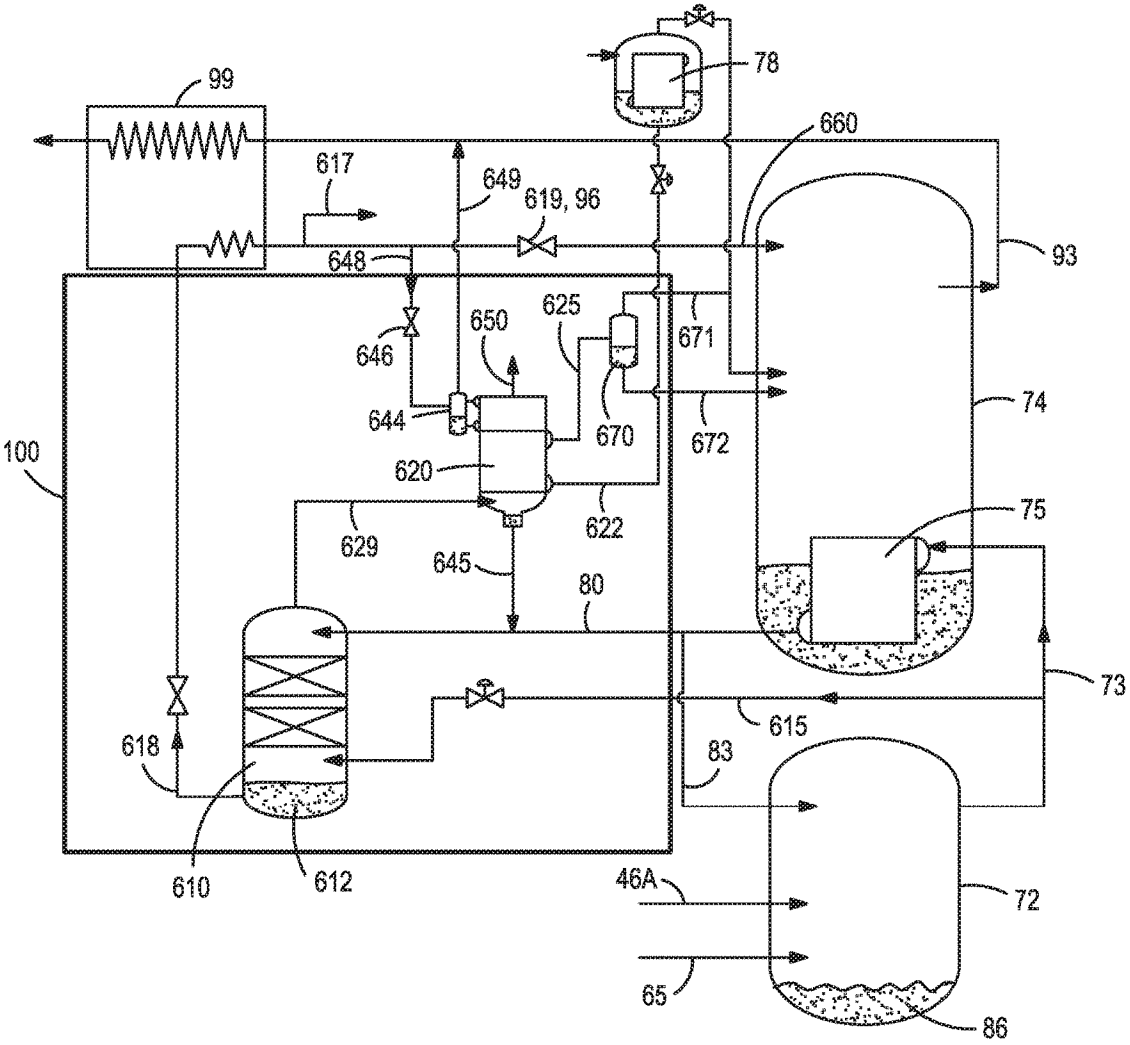
FIG. 8 is a more detailed schematic representation of the non-condensable gas recovery system of FIG. 6.

Turning now to FIG. 7 and FIG. 8, additional embodiments of the non-condensable gas recovery system 100 are shown that comprises a non-condensable stripping column (NSC) 510, 610 and a condenser-reboiler 520, 620. The non-condensable stripping columns 510, 610 illustrated in FIGS. 7 and 8 are configured to receive a portion of nitrogen shelf vapor 515, 615 from the higher pressure column 72 which is introduced proximate the bottom of the non-condensable stripping column 510, 610 as an ascending vapor stream. The descending liquid reflux for the non-condensable stripping column 510, 610 includes: (i) a stream of liquid nitrogen 80 exiting the main condenser-reboiler 75; and (ii) a stream of liquid nitrogen condensate 545, 645 exiting the condenser-reboiler 520, 620. As the ascending vapor (i.e. stripping vapor) rises within the non-condensable stripping column 510, 610, the mass transfer occurring in the non-condensable stripping column 510, 610 will concentrate the heavier components like oxygen, argon, and nitrogen in the descending liquid phase while the ascending vapor phase is enriched in lighter components like neon, hydrogen, and helium. As a result of the mass transfer, the non-condensable stripping column 510, 610 produces liquid nitrogen bottoms 512, 612 and an overhead gas 529, 629 containing higher concentrations of non-condensables that is fed into the condenser-reboiler 520, 620.

The liquid nitrogen bottoms 512, 612 from the non-condensable stripping column 510, 610 forms a liquid nitrogen reflux stream 518, 618 and is preferably subcooled in a subcooler unit 99 against a stream of waste nitrogen 93 from the air separation unit 10. Portions of the subcooled liquid nitrogen reflux stream may optionally be taken as liquid nitrogen product 517, 617; diverted to the condenser-reboiler 520, 620; or expanded in valve 519, 619 and returned as a reflux stream 560, 660 to the lower pressure column 74 of the air separation unit 10. Similar to the earlier described embodiments, the illustrated subcooler unit 99 may be an existing subcooler in the air separation unit 10 or may be a standalone unit that forms part of the non-condensable gas recovery system 100.

In the embodiments of FIG. 7 and FIG. 8, the condenser-reboiler 520, 620 is preferably a two stage condenser-reboiler that provides two levels of refrigeration to partially condense most of the overhead vapor 529, 629 from the non-condensable stripping column 510, 610. The illustrated reflux condenser-reboiler 520 of FIG. 7 is configured to receive the overhead gas 529 containing neon and other non-condensables from the non-condensable stripping column 510, a first condensing medium 522 that comprises a kettle boiling stream diverted from a nitrogen subcooler of the air separation unit 10, and a second condensing medium 548 that comprises a throttled portion via valve 546 of the subcooled liquid nitrogen reflux stream. The two-stage reflux condenser-reboiler 520 is configured to produce a stream of liquid nitrogen condensate 545 that is returned as reflux to the non-condensable stripping column 510, a two phase boil-off stream 525 that is directed to the argon condenser 78 of the air separation unit 10, and a crude neon vapor stream 550 that is withdrawn from the top of the condenser-reboiler 520 and that contains greater than about 50% mole fraction of neon. The crude neon vapor stream may further contain greater than about 10% mole fraction of helium. Boil-off stream 549 is removed from phase separator 544 and fed into the waste stream 93. As with the other above-described embodiments, the overall neon recovery for the illustrated non-condensable gas recovery system is above 95%. An additional benefit of the depicted non-condensable gas recovery system is that there is minimal liquid nitrogen consumption and since much of the liquid nitrogen is recycled back to the lower pressure column, there is minimal impact on the separation and recovery of other product slates in the air separation unit 10.

In many regards, the embodiment of FIG. 8 is quite similar to that shown in FIG. 7 with corresponding elements and streams having corresponding reference numerals but numbered in the 600 series in FIG. 8 and in the 500 series in FIG. 7. For example, the items designated by reference numerals 522, 525, 544, 545, 546, 548, 549, and 550 in FIG. 7 are the same or similar to the, the items designated by reference numerals 622, 625, 644, 645, 646, 648, 649, and 650 in FIG. 8, respectively. The primary differences between the embodiment of FIG. 7 and the embodiment of FIG. 8 being the kettle boiling stream from a nitrogen subcooler of the air separation unit is replaced by a kettle boiling stream 622 from the argon condenser 78 of the air separation unit 10. In addition, the boiling stream 625 produced by the two stage reflux condenser-reboiler 620 is directed to a phase separator 670 with the resulting vapor stream 671 and liquid stream 672 being returned to intermediate locations of the lower pressure column 74 of the air separation unit 10.

EXAMPLES

For various embodiments of the present system and method of recovering neon, a number of process simulations were run using various air separation unit operating models to characterize: (i) the recovery of neon and other rare gases; (ii) the make-up of the crude neon vapor stream; and (iii) net loss of nitrogen from the distillation column system; when operating the air separation unit using the neon recovery systems and methods described above and shown in the associated Figs.

Table 1 shows the results of the computer based process simulation for the neon recovery system and associated methods described with reference to FIG. 2. As seen in Table 1, the air separation unit is operated with incoming feed air stream of 4757.56 kcfh and 37.86 kcfh of liquid air stream to the higher pressure column at roughly 97 psia. Roughly 45.00 kcfh of shelf nitrogen vapor at 92 psia is diverted from the higher pressure column to the neon recovery system while roughly 2174.74 kcfh of liquid nitrogen at 92 psia is diverted from the main condenser-reboiler of the distillation column system to the neon recovery system. Excluding any liquid nitrogen product taken directly from the neon recovery system, the neon recovery system is capable of returning about 99.31% of the diverted streams back to the distillation column system in the form of subcooled liquid nitrogen to the lower pressure column (i.e. 2219.58 kcfh of liquid reflux from non-condensable stripping column less 15.31 kcfh of subcooled liquid nitrogen to the neon upgrader equals 2204.27 kcfh of subcooled liquid nitrogen returned to the lower pressure column). The recovery of neon and other rare gases includes about 96.85% recovery of neon. Neon recovery is calculated by taking the flow rate of the crude neon stream (0.16 kcfh) times the neon content in the crude neon stream (51.89%) and dividing that number (0.083024 kcfh) by the contained neon in both main air stream (4757.56 kcfh*0.00182%) and liquid air stream (37.86 kcfh*0.00182%) into the distillation column system. As seen in Table 1, the make-up of the crude neon vapor stream includes 51.89% neon and 15.25% helium.

TABLE 1

(Process Simulation of Neon Recovery System of FIG. 2 and Associated Methods)

| | Main Air | Liquid Air | Shelf Vapor from HPC | Shelf Liquid from MC | Liquid N2 to Ne Upgrader | Liquid Reflux from NSC |
|---|---|---|---|---|---|---|
| Stream # | 65 | 46 | 215 | 80 | 229 | 218 |
| Temp (K) | 106.20 | 100.02 | 97.19 | 97.11 | 79.68 | 99.27 |
| Pressure (psia) | 97.28 | 96.78 | 92.00 | 92.00 | 19.00 | 107.00 |
| Flow (kcfh) | 4757.56 | 37.86 | 45.00 | 2174.74 | 15.31 | 2219.58 |
| N2 | 0.7811 | 0.7811 | 0.9995 | 0.9995 | 0.9996 | 0.9996 |
| Ar | 9.34E−03 | 9.34E−03 | 3.88E−04 | 3.88E−04 | 3.88E−04 | 3.88E−04 |
| O2 | 0.2095 | 0.2095 | 7.08E−06 | 7.08E−06 | 7.07E−06 | 7.07E−06 |
| Kr | 1.14E−06 | 1.14E−06 | 7.23E−31 | 7.23E−31 | 9.98E−31 | 9.98E−31 |
| Xe | 8.70E−08 | 8.70E−08 | 8.72E−31 | 8.72E−31 | 9.96E−31 | 9.96E−31 |
| H2 | 1.00E−06 | 1.00E−06 | 2.14E−06 | 2.14E−06 | 4.83E−08 | 4.83E−08 |
| Ne | 1.82E−05 | 1.82E−05 | 3.90E−05 | 3.90E−05 | 8.83E−07 | 8.83E−07 |
| He | 5.20E−06 | 5.20E−06 | 1.12E−05 | 1.12E−05 | 1.26E−08 | 1.26E−08 |
| CO | 1.00E−06 | 1.00E−06 | 1.01E−06 | 1.01E−06 | 1.01E−06 | 1.01E−06 |

| | Boil-off N2 Recycled to NSC | Total Vapor to NSC | Vent from NSC Condenser | Liquid from Ne Upgrader | Crude Neon from Ne Upgrader | Liquid to NSC Condenser |
|---|---|---|---|---|---|---|
| Stream # | 225 | 235 | 229 | 245 | 250 | 216 |
| Temp (K) | 97.19 | 102.70 | 99.03 | 99.03 | 83.53 | 97.18 |
| Press (psia) | 92.00 | 107.00 | 106.00 | 106.00 | 105.50 | 92.00 |
| Flow (kcfh) | 225.00 | 270.00 | 18.57 | 18.41 | 0.16 | 225.00 |
| N2 | 0.9996 | 0.9996 | 0.9936 | 0.9998 | 0.3000 | 0.9996 |
| Ar | 3.88E−04 | 3.86E−04 | 5.99E−05 | 6.04E−05 | 1.10E−06 | $3.88E^{-04}$ |
| O2 | 7.07E−06 | 7.03E−06 | 6.51E−07 | 6.57E−07 | 5.41E−09 | $7.07E^{-06}$ |
| Kr | 9.98E−31 | 9.98E−31 | 9.98E−31 | 9.98E−31 | 9.98E−31 | $9.98E^{-31}$ |
| Xe | 9.96E−31 | 9.97E−31 | 9.96E−31 | 9.96E−31 | 9.96E−31 | $9.96E^{-31}$ |
| H2 | 4.83E−08 | 3.98E−07 | 2.58E−04 | 7.69E−06 | 2.85E−02 | $4.83E^{-08}$ |
| Ne | 8.83E−07 | 7.23E−06 | 4.69E−03 | 1.39E−04 | 0.5189 | $8.83E^{-07}$ |
| He | 1.26E−08 | 1.88E−06 | 1.35E−03 | 7.75E−06 | 0.1525 | $1.26E^{-08}$ |
| CO | 1.01E−06 | 1.00E−06 | 4.81E−07 | 4.85E−07 | 4.79E−08 | $1.01E^{-06}$ |

Table 2 shows the results of the computer based process simulation for the neon recovery system and associated methods described with reference to FIG. 4. As seen in Table 2, the air separation unit is operated with incoming feed air stream of 4757.56 kcfh and 37.86 kcfh of liquid air stream to the higher pressure column at roughly 97 psia. About 270.00 kcfh of shelf nitrogen vapor at roughly 92 psia is diverted from the higher pressure column to the neon recovery system while roughly 1949.88 kcfh of liquid nitrogen at roughly 92 psia is diverted from the main condenser-reboiler of the distillation column system to the neon recovery system. Excluding any liquid nitrogen product taken directly from the neon recovery system, the neon recovery system is capable of returning over 99% of the diverted streams back to the distillation column system in the form of subcooled liquid nitrogen to the lower pressure column (i.e. 2219.74 kcfh of liquid reflux from non-condensable stripping column less 15.74 kcfh of subcooled liquid nitrogen to the neon upgrader equals 2204.00 kcfh of subcooled liquid nitrogen returned to the lower pressure column). The recovery of neon and other rare gases includes about 96.44% recovery of neon while the make-up of the crude neon vapor stream includes 51.89% neon and 15.25% helium.

TABLE 2

(Process Simulation of Neon Recovery System of FIG. 4 and Associated Methods)

| | Main Air | Liquid Air | Shelf Vapor from HPC | Shelf Liquid from MC | Liquid Reflux from NSC | LOX from LPC Sump | GOX return to LPC |
|---|---|---|---|---|---|---|---|
| Stream # | 65 | 46 | 315 | 80 | 318 | 322 | 324 |
| Temp (K) | 106.20 | 100.02 | 97.18 | 97.11 | 97.11 | 95.78 | 95.78 |
| Press (psia) | 97.28 | 96.78 | 91.95 | 91.95 | 91.50 | 25.50 | 25.50 |
| Flow (kcfh) | 4757.56 | 37.86 | 270.00 | 1949.88 | 2219.74 | 180.09 | 180.09 |
| N2 | 0.7811 | 0.7811 | 0.9996 | 0.9996 | 0.9996 | 0.00 | 0.00 |
| Ar | 9.34E−03 | 9.34E−03 | 3.89E−04 | 3.89E−04 | 3.89E−04 | 1.32E−03 | 1.32E−03 |
| O2 | 0.2095 | 0.2095 | 7.08E−06 | 7.08E−06 | 7.08E−06 | 0.9987 | 0.9987 |
| Kr | 1.14E−06 | 1.14E−06 | 9.94E−31 | 9.94E−31 | 9.86E−31 | 5.44E−06 | 5.44E−06 |
| Xe | 8.70E−08 | 8.70E−08 | 1.00E−30 | 1.00E−30 | 9.96E−31 | 4.15E−07 | 4.15E−07 |
| H2 | 1.00E−06 | 1.00E−06 | 2.14E−06 | 2.14E−06 | 5.59E−08 | 0 | 0 |
| Ne | 1.82E−05 | 1.82E−05 | 3.90E−05 | 3.90E−05 | 1.03E−06 | 0 | 0 |
| He | 5.20E−06 | 5.20E−06 | 1.12E−05 | 1.12E−05 | 4.92E−08 | 0 | 0 |
| CO | 1.00E−06 | 1.00E−06 | 1.01E−06 | 1.01E−06 | 1.00E−06 | 0 | 0 |

TABLE 2-continued (Process Simulation of Neon Recovery System of FIG. 4 and Associated Methods)

| | Vapor to NSC Condenser | Liquid from NSC Condenser | Vent from NSC Condenser | Liquid from Neon Upgrader | Crude Ne from Neon Upgrader | Liquid N2 to Neon Upgrader |
|---|---|---|---|---|---|---|
| Stream # | 315 | 327 | 329 | 345 | 350 | 348 |
| Temp (K) | 96.92 | 96.91 | 96.82 | 96.82 | 82.07 | 79.68 |
| Press (psia) | 90.25 | 90.25 | 90.25 | 90.25 | 89.75 | 19.00 |
| Flow (kcfh) | 269.47 | 250.90 | 18.57 | 18.41 | 0.16 | 15.74 |
| N2 | 0.9994 | 0.9999 | 0.9937 | 0.9998 | 0.3000 | 0.9996 |
| Ar | 1.86E−04 | 1.96E−04 | 5.25E−05 | 5.29E−05 | 8.41E−07 | 3.89E−04 |
| O2 | 2.78E−06 | 2.95E−06 | 5.47E−07 | 5.52E−07 | 3.77E−09 | 7.08E−06 |
| Kr | 9.84E−31 | 9.84E−31 | 9.84E−31 | 9.84E−31 | 9.84E−31 | 9.86E−31 |
| Xe | 9.94E−31 | 9.94E−31 | 9.94E−31 | 9.94E−31 | 9.94E−31 | 9.96E−31 |
| H2 | 1.81E−05 | 5.68E−07 | 2.56E−04 | 6.20E−06 | 2.86E−02 | 5.59E−08 |
| Ne | 3.36E−04 | 1.70E−05 | 4.65E−03 | 1.14E−04 | 0.5189 | 1.03E−06 |
| He | 9.26E−05 | 4.75E−07 | 1.34E−03 | 5.64E−06 | 0.1525 | 4.92E−08 |
| CO | 7.43E−07 | 7.65E−07 | 4.51E−07 | 4.55E−07 | 4.22E−08 | 1.00E−06 |

Table 3 shows the results of the computer based process simulation for the neon recovery system and associated methods described with reference to FIG. 7. As seen in Table 3, the air separation unit is operated with incoming feed air stream of 4757.56 kcfh and 37.86 kcfh of liquid air stream to the higher pressure column at roughly 97 psia. About 140.00 kcfh of shelf nitrogen vapor at roughly 92 psia is diverted from the higher pressure column to the neon recovery system while roughly 2079.82 kcfh of liquid nitrogen at roughly 92 psia is diverted from the main condenser-reboiler of the distillation column system to the neon recovery system. Excluding any liquid nitrogen product taken directly from the neon recovery system, the neon recovery system is capable of returning over 99% of the diverted streams back to the distillation column system in the form of subcooled liquid nitrogen to the lower pressure column (i.e. 2219.67 kcfh of liquid reflux from non-condensable stripping column less 15.74 kcfh of subcooled liquid nitrogen to the neon upgrader equals 2203.93 kcfh of subcooled liquid nitrogen returned to the lower pressure column). The recovery of neon and other rare gases includes over 95.16% recovery of neon while the make-up of the crude neon vapor stream includes 51.74% neon and 15.41% helium.

TABLE 3

(Process Simulation of Neon Recovery System of FIG. 7 and Associated Methods)

| | Main Air | Liquid Air | Shelf Vapor from HPC | Shelf Liquid from MC | Kettle to 2-Stage NSC Condenser | Boil-Off from 2-Stage NSC Condenser |
|---|---|---|---|---|---|---|
| Stream # | 65 | 47 | 515 | 80 | 522 | 525 |
| Temp (K) | 106.20 | 100.02 | 97.18 | 97.11 | 95.78 | 95.88 |
| Press (psia) | 97.28 | 96.78 | 91.95 | 91.95 | 60.56 | 60.56 |
| Flow (kcfh) | 4757.56 | 37.86 | 140.00 | 2079.82 | 2575.60 | 2575.60 |
| N2 | 0.7811 | 0.7811 | 0.9996 | 0.9996 | 0.5928 | 0.5928 |
| Ar | 9.34E−03 | 9.34E−03 | 3.88E−04 | 3.88E−04 | 1.71E−02 | 1.71E−02 |
| O2 | 0.2095 | 0.2095 | 7.08E−06 | 7.08E−06 | 0.3901 | 0.3901 |
| Kr | 1.14E−06 | 1.14E−06 | 9.97E−31 | 9.97E−31 | 2.12E−06 | 2.12E−06 |
| Xe | 8.70E−08 | 8.70E−08 | 9.98E−31 | 9.98E−31 | 1.62E−07 | 1.62E−07 |
| H2 | 1.00E−06 | 1.00E−06 | 2.14E−06 | 2.14E−06 | 1.51E−08 | 1.51E−08 |
| Ne | 1.82E−05 | 1.82E−05 | 3.90E−05 | 3.90E−05 | 3.03E−07 | 3.03E−07 |
| He | 5.20E−06 | 5.20E−06 | 1.12E−05 | 1.12E−05 | 2.41E−08 | 2.41E−08 |
| CO | 1.00E−06 | 1.00E−06 | 1.01E−06 | 1.01E−06 | 9.94E−07 | 9.94E−07 |

| | Vapor to 2-Stage NSC Condenser | Liquid from 2-Stage NSC Condenser | Crude Ne out 2-Stage NSC Condenser | Liquid N2 to 2-Stage NSC Condenser | Liquid Reflux from NSC |
|---|---|---|---|---|---|
| Stream # | 529 | 545 | 550 | 548 | 518 |
| Temp (K) | 96.9111239 | 96.903684 | 82.0676857 | 79.6776 | 97.1092 |
| Press (psia) | 90.25 | 90.25 | 89.75 | 19.00 | 91.5 |
| Flow (kcfh) | 139.77 | 139.62 | 0.16 | 15.74 | 2219.67 |
| N2 | 0.9991 | 0.9991 | 0.3000 | 0.9996 | 0.9996 |
| Ar | 1.92E−04 | 1.91E−04 | 8.46E−07 | 3.88E−04 | 3.88E−04 |
| O2 | 2.89E−06 | 2.88E−06 | 3.83E−09 | 7.08E−06 | 7.08E−06 |
| Kr | 9.90E−31 | 8.74E−31 | 8.74E−31 | 9.90E−31 | 9.90E−31 |
| Xe | 9.91E−31 | 8.75E−31 | 8.75E−31 | 9.91E−31 | 9.91E−31 |
| H2 | 3.36E−05 | 9.43E−07 | 2.85E−02 | 8.39E−08 | 8.39E−08 |
| Ne | 6.18E−04 | 2.37E−05 | 0.5174 | 1.55E−06 | 1.55E−06 |
| He | 1.78E−04 | 8.34E−07 | 0.1541 | 4.97E−08 | 4.97E−08 |
| CO | 7.55E−07 | 7.00E−07 | 3.93E−08 | 1.00E−06 | 1.00E−06 |

Although the present system for recovery of rare and non-condensable gases from an air separation unit has been discussed with reference to one or more preferred embodiments and methods associated therewith, as would occur to those skilled in the art that numerous changes and omissions can be made without departing from the spirit and scope of the present inventions as set forth in the appended claims.

What is claimed is:

1. A neon recovery system for an air separation unit, the air separation unit comprising a main air compression system, a pre-purification system, a heat exchanger system, and a rectification column system having a higher pressure column and a lower pressure column linked in a heat transfer relationship via a main condenser-reboiler, the neon recovery system comprising:

a non-condensable stripping column configured to receive a portion of a liquid nitrogen stream from the main condenser-reboiler and a stream of nitrogen rich shelf vapor from the higher pressure column, the non-condensable stripping column further configured to produce a liquid nitrogen column bottoms and a non-condensable gas containing overhead;

a stripping column condenser configured to receive the non-condensable gas containing overhead from the non-condensable stripping column and a first condensing medium, the stripping column condenser further configured to produce a first condensate that is released into or directed to the non-condensable stripping column and a first stream formed from the vaporization or partial vaporization of the first condensing medium; and a neon upgrader configured to receive a non-condensable containing vent stream from the stripping column condenser and a second condensing medium, the neon upgrader further configured to produce a second condensate that is released into or directed to the non-condensable stripping column, a boil off stream formed from the vaporization or partial vaporization of the second condensing medium, and a crude neon vapor stream that contains greater than about 50% mole fraction of crude neon vapor;

wherein all or a portion of the liquid nitrogen column bottoms is subcooled to produce a subcooled liquid nitrogen stream and the second condensing medium is a portion of the subcooled liquid nitrogen stream.

2. The neon recovery system of claim 1, wherein the crude neon vapor stream further contains greater than about 10% mole fraction of helium.

3. The neon recovery system of claim 1, wherein the first condensing medium is a kettle boiling stream from the higher pressure column of the air separation unit.

4. The neon recovery system of claim 3, wherein the first stream formed from the partial vaporization of the first condensing medium is directed to an argon condenser of the air separation unit.

5. The neon recovery system of claim 1, wherein the first condensing medium is a kettle boiling stream from an argon condenser of the air separation unit.

6. The neon recovery system of claim 5, wherein the first stream formed from the partial vaporization of the first condensing medium is directed to a phase separator configured to produce a vapor stream and a liquid stream that are returned to intermediate locations of the lower pressure column of the air separation unit.

7. The neon recovery system of claim 1, wherein a first portion of the subcooled liquid nitrogen stream is directed to the neon upgrader as the second condensing medium and a second portion of the subcooled liquid nitrogen stream is directed to the lower pressure column of the air separation unit as a reflux stream.

8. The neon recovery system of claim 1, wherein a first portion of the subcooled liquid nitrogen stream is directed to the neon upgrader as the second condensing medium; a second portion of the subcooled liquid nitrogen stream is directed to the lower pressure column as a reflux stream; and a third portion is taken as a liquid nitrogen product stream.

9. The neon recovery system of claim 1, wherein the subcooled liquid nitrogen stream is subcooled via indirect heat exchange with a nitrogen column overhead of the lower pressure column of the air separation unit.

10. The neon recovery system of claim 1, wherein the vapor portion of the boil off stream formed from the vaporization or partial vaporization of the second condensing medium is combined with a waste nitrogen stream of the air separation unit.

11. A method of recovering neon from an air separation unit, the air separation unit comprising a main air compression system, a pre-purification system, a heat exchanger system, and a rectification column system having a higher pressure column and a lower pressure column linked in a heat transfer relationship via a main condenser-reboiler, the method comprising the steps of:

directing a stream of liquid nitrogen from the main condenser-reboiler and a stream of nitrogen rich shelf vapor from the higher pressure column to a non-condensable stripping column configured to produce a liquid nitrogen column bottoms and a non-condensable gas containing overhead;

subcooling all or a portion of the liquid nitrogen column bottoms to produce a subcooled liquid nitrogen stream;

condensing nitrogen from the non-condensable gas containing overhead against a first condensing medium and a first portion of the subcooled liquid nitrogen stream in a stripping column condenser while vaporizing or partially vaporizing the first condensing medium to produce a first stream and also producing a non-condensable containing vent stream;

releasing or directing the condensed nitrogen from the stripping column condenser into the non-condensable stripping column;

condensing nitrogen from the non-condensable containing vent stream in a neon upgrader against a second condensing medium;

releasing or directing the condensed nitrogen from the neon upgrader into the non-condensable stripping column; while vaporizing or partially vaporizing the second condensing medium to produce a boil off stream and also producing a crude neon vapor stream that contains greater than about 50% mole fraction of crude neon vapor.

12. The method of recovering neon of claim 11, wherein the crude neon vapor stream further contains greater than about 10% mole fraction of helium.

13. The method of recovering neon of claim 11, further comprising the step of directing a kettle boiling stream from the higher pressure column of the air separation unit to the stripping column condenser as the first condensing medium.

14. The method of recovering neon of claim 13, further comprising the step of directing the first stream formed from the vaporization or partial vaporization of the first condensing medium to an argon condenser of the air separation unit.

15. The method of recovering neon of claim 11, further comprising the step of directing a kettle boiling stream from an argon condenser of the air separation unit to the stripping column condenser as the first condensing medium.

16. The method of recovering neon of claim 15, further comprising the steps of:

phase separating the first stream formed from the vaporization or partial vaporization of the first condensing medium to produce a vapor stream and a liquid stream; and directing the vapor stream and the liquid stream to intermediate locations of the lower pressure column of the air separation unit.

17. The method of recovering neon of claim 11, further comprising the step of directing a second portion of the subcooled liquid nitrogen stream to the lower pressure column of the air separation unit as a reflux stream.

18. The method of recovering neon of claim 17, further comprising the step of taking a third portion of the subcooled liquid nitrogen stream as a liquid nitrogen product stream.

19. The method of recovering neon of claim 11, wherein the step of subcooling all or a portion of the liquid nitrogen column bottoms to produce the subcooled liquid nitrogen stream further comprises subcooling the liquid nitrogen column bottoms via indirect heat exchange with a nitrogen column overhead of the lower pressure column of the air separation unit.

* * * * *